United States Patent [19]

Wood

[11] 4,326,628

[45] Apr. 27, 1982

[54] BOTTLE CARRIER

[75] Inventor: Prentice J. Wood, Hapeville, Ga.

[73] Assignee: The Mead Corporation, Dayton, Ohio

[21] Appl. No.: 205,583

[22] Filed: Nov. 7, 1980

[51] Int. Cl.[3] ..... B65D 85/62; B65D 71/00; B65D 75/00

[52] U.S. Cl. ..... 206/158; 206/153; 206/427; 229/52 BC; 294/87.2

[58] Field of Search ..... 206/152, 153, 158, 162, 206/161, 199, 427; 229/52 BC; 294/87.2, 87.26

[56] References Cited

U.S. PATENT DOCUMENTS

| | | | |
|---|---|---|---|
| 2,397,716 | 4/1946 | Wendler | 294/87.2 |
| 2,737,326 | 3/1956 | Toensmeier | 206/158 |
| 3,123,213 | 3/1964 | Kulig | 206/158 |
| 3,528,697 | 9/1970 | Wood | 294/87.2 |
| 3,744,704 | 7/1973 | Struble | 229/52 BC |
| 4,250,991 | 2/1981 | Manizza et al. | 206/153 |

*Primary Examiner*—William T. Dixson, Jr.
*Attorney, Agent, or Firm*—Rodgers & Rodgers

[57] ABSTRACT

A bottle carrier for enveloping the flanged necks of a plurality of bottles arranged in two rows of at least two bottles each includes an apertured bottom panel arranged with the bottle neck receiving apertures disposed in at least two rows, a locking notch formed in each aperture and located adjacent the longitudinal medial center line of the bottom panel, an inwardly and upwardly tapered side wall foldably joined to each side edge of the bottom panel, an inwardly and downwardly tapered support wall foldably joined to the top edge of each of said side walls, a plurality of apertures formed in each of said side walls and in each of said support walls and near the upper edges thereof to define a plurality of neck receiving apertures for engaging the flanges of the bottle necks respectively and a plurality of locking tabs formed along the bottom edges of said support walls and arranged to engage said notches respectively thereby to interconnect said support walls with said bottom panel. If desired handle panels may be foldably joined to the bottom edges of the support walls and may project upwardly therefrom and guide panels struck from the bottle neck receiving apertures in the bottom panel and folded upwardly so as to engage the respective locking tabs during assembly of the carrier.

According to a modification of the invention, cover panel elements instead of handle panels may be foldably joined to the bottom edges of the support walls and may be arranged so as to overlie the medial portion of the bottom wall which is disposed between the bottom edges of the support panels.

19 Claims, 6 Drawing Figures

BOTTLE CARRIER

BACKGROUND ART

Top gripping bottle carriers are well known in the art and may take different forms depending on the nature and size of the bottles to be packaged. One example of a bottle carrier which is especially adapted for use in conjunction with a single row of flanged bottles is disclosed in U.S. Pat. No. 4,180,191 issued Dec. 25, 1979 and owned by the assignee of this invention. This bottle carrier is particularly sturdy and is well suited for use in conjunction with large bottles. In order to assemble a bottle carrier according to this patent, an application of glue is required and since the carrier is particularly sturdy, it is mandatory that easy opening tear strips be incorporated as a feature of the carrier.

U.S. Pat. No. 4,190,149 issued Feb. 26, 1980 as well as U.S. Pat. No. 4,192,540 issued Mar. 11, 1980 both owned by the assignee of this invention disclose top gripping article carriers which are adapted for packaging bottles arranged in at least two rows of at least two bottles each. These two types of carriers are well suited for use in conjunction with bottles having screw-on resealable type caps but are not especially well adapted for use in conjunction with bottles having integral outwardly protruding flanged neck portions.

DISCLOSURE OF THE INVENTION

A bottle carrier according to the present invention is well suited for use in conjunction with bottles of intermediate size and having integrally formed pronounced flanged neck portions and is well suited for packaging bottles arranged in two rows of at least two bottles each although the invention is not limited to packaging bottles arranged in two rows.

The invention in one form which at present is the preferred form of the invention comprises a bottom panel having bottle neck receiving apertures arranged in two rows of at least two bottles each, a plurality of guide panels struck from the apertures formed in the bottom panel and projecting upwardly from fold lines forming a notched portion of each aperture and which notch portions are disposed adjacent the medial center line of the bottom panel, a side wall foldably joined to each side edge of the bottom panel and inwardly inclined upwardly, a support panel foldably joined to each of said side walls and inwardly inclined downwardly, a plurality of support apertures formed astride each fold line between each side wall and each support wall for engaging the flanges of the associated bottles, a plurality of locking tabs formed along the lower edge of each support panel and disposed within the locking notches of the neck receiving apertures so as to anchor the support walls with their lower edges adjacent the bottom panel, and a pair of handle panels projecting upwardly and respectively foldably joined to the bottom edges of the support walls and disposed outside and in enveloping relation relative to the guide panels.

According to a modification of the invention the handle panels may be omitted along with the guide panels and cover panel elements may be foldably joined to the bottom edge of one or both of the support panels and may be arranged so as to overlie the medial part of the bottom wall which is disposed between the bottom edges of the support panels.

According to still another modification of the invention the cover panels, as well as the handle panels and the guide panels may be omitted altogether.

BEST MODE OF CARRYING OUT THE INVENTION

Figure 1:
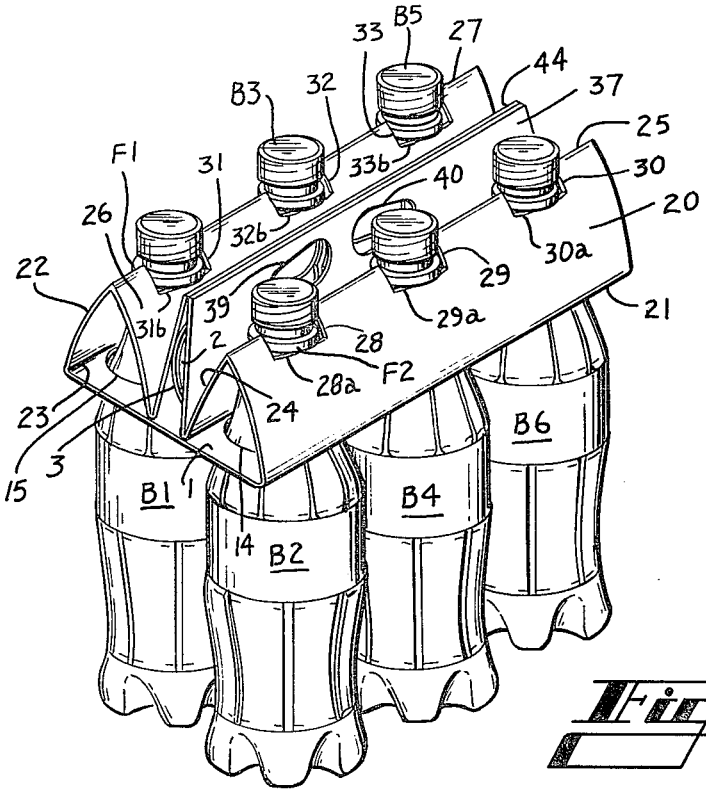
FIG. 1 is a perspective view of a top gripping article carrier formed in accordance with a preferred form of the invention and shows an article carrier in assembled relation to a group of packaged bottles.
Figure 3:
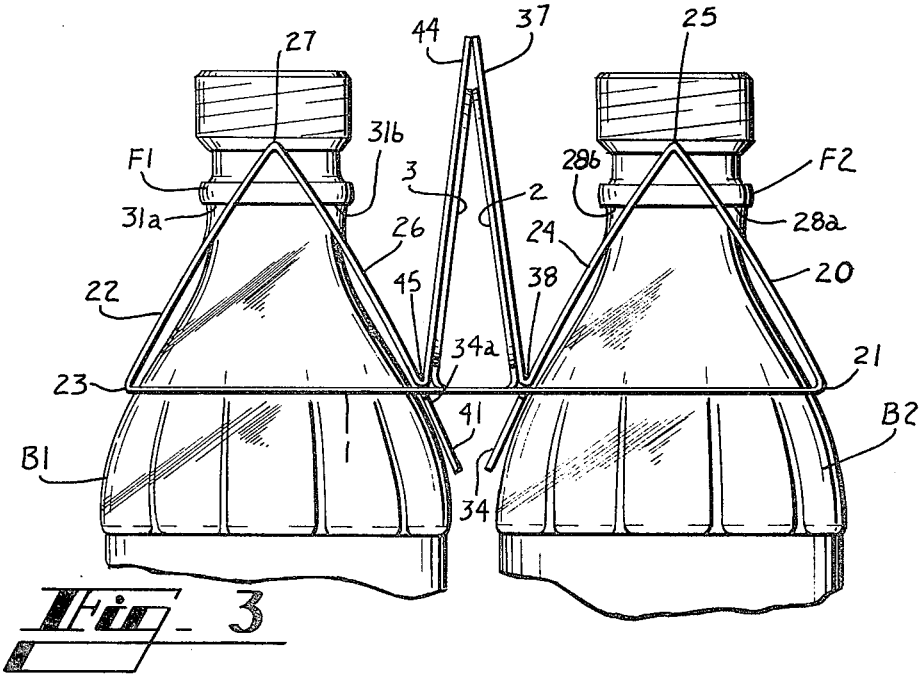
FIG. 3 is an end view of a carrier formed from the blank of FIG. 2 and which shows the assembled relationship between the locking tabs, the handle panels and the guide panels.
Figure 2:
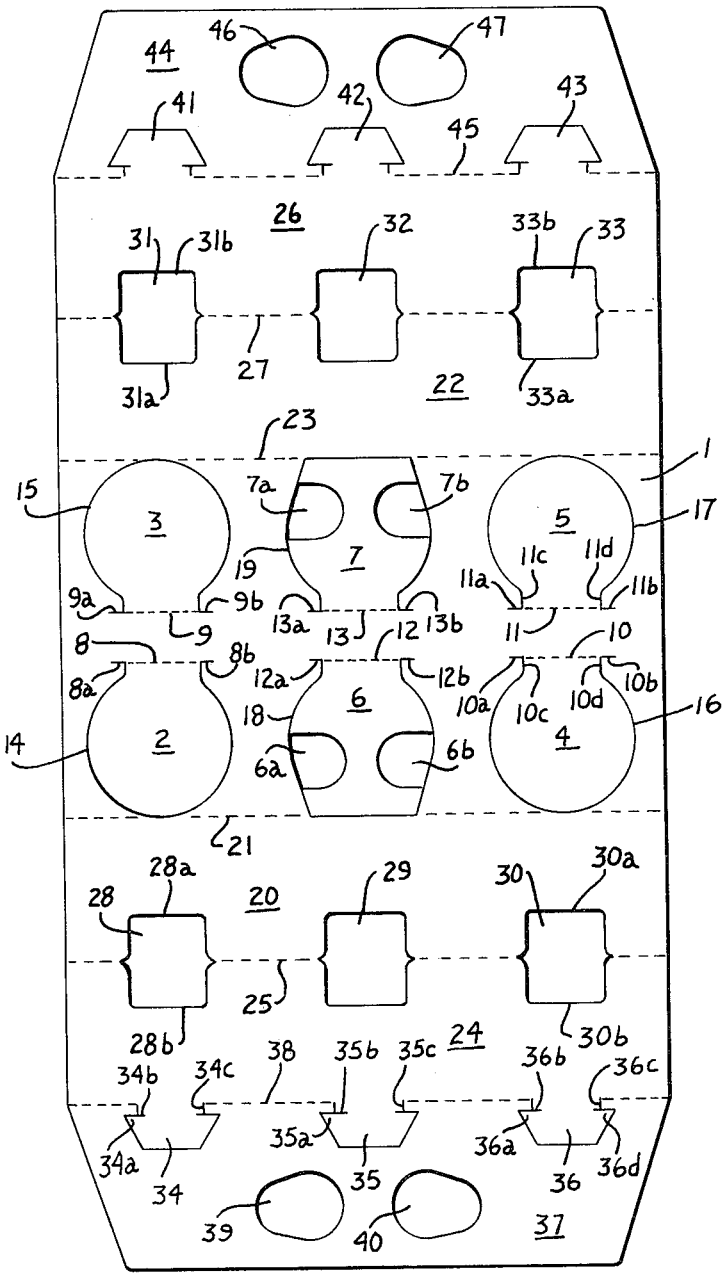
FIG. 2 is a plan view of a blank from which the carrier shown in FIG. 1 is formed.

The preferred form of the invention as shown in FIGS. 1, 2 and 3 includes a bottom panel 1 which from end guide panels 2, 3, 4, and 5 are struck and from which center guide panels 6 and 7 are struck. The guide panels 2 and 3 are foldably joined to bottom panel 1 along fold lines 8 and 9 respectively. Fold line 8 preferably is arranged in aligned relationship to end slits **8*a* and 8*b* which together with fold line 8 are generally parallel to fold line 9 which includes end slits 9*a* and 9*b*. In similar fashion end guide panel 4 is foldably joined to bottom panel 1 along fold line 10 which is arranged in alignment with end slits 10*a* and 10*b*. End guide panel 5 is foldably joined to bottom panel 1 along fold line 11 which is arranged in alignment with slits 11*a* and 11*b*. Fold lines 10 and 11 and their associated end slits are in general parallel relation to each other. Guide panels 6 and 7 are foldably joined to the bottom wall 1 along parallel fold lines 12 and 13 and end slits 12*a* and 12*b* are aligned with fold line 12 while end slits 13*a* and 13*b* are aligned with fold line 13. Center guide panel 6 is provided with a pair of cutaway areas 6*a* and 6*b* while center guide panel 7 is formed with cutaway areas 7*a* and 7*b***.

The apertures 14–19 inclusive which are respectively defined by guide panels 2–7 inclusive and which are exposed when the guide panels are folded upwardly in accordance with a feature of this invention constitute bottle neck receiving apertures.

Side wall 20 is foldably joined to bottom panel 1 along fold line 21 and on the other side of the carrier side wall 22 is foldably joined to the opposite side edge of bottom panel 1 along fold line 23.

A support wall 24 is foldably joined to side wall 20 along interrupted fold line 25 and support wall 26 is foldably joined to side wall 22 along fold line 27.

Apertures 28–30 are of generally rectangular configuration and are disposed astride the fold line 25. The edges such as **30*a* and 30*b* of aperture 28 are arranged to engage outwardly projecting neck flanges such as F1** of the packaged bottles thus to provide support therefor.

Generally rectangular apertures 31–33 inclusive are disposed astride fold line 27 and thus are struck from side wall 22 and support wall 26 and receive the necks of packaged bottles and flanges such as F2 engage the side edges of these apertures such as 33*a* and 33*b* and provide support therefor.

Locking tabs 34–36 inclusive are integrally formed with support wall 24 and include shoulder portions 34*a*, 35*a* and 36*a* as well as inwardly projecting slits 34*b*, 35*b*, and 36*b*. Each locking tab includes a neck portion 34*c*, 35*c*, and 36*c*.

For facilitating portability of the carrier a handle panel 37 is foldably joined to support wall 24 along interrupted fold line 38 and includes a pair of finger gripping apertures 39 and 40.

At the other end of the blank, a plurality of locking tabs 41, 42 and 43 are integrally formed with support wall 26 and are identical in construction to the locking tabs 34–36 respectively.

A handle panel 44 is foldably joined to support wall 26 along interrupted fold line 45 and includes a pair of finger gripping apertures 46 and 47.

In order to assemble the carrier formed from the blank shown in FIG. 2 into set up condition represented in FIGS. 1 and 3, the guide panels 2–7 are folded out of the plane of bottom panel 1 upwardly to a position somewhat as shown in connection with guide panels 4 and 5 in FIG. 3. Thereafter side wall panels 20 and 26 are elevated and folded along fold lines 21 and 23 while support panels 24 and 26 are simultaneously folded inwardly along their respective fold lines 25 and 27 and handle panels 37 and 44 are folded upwardly along their respective fold lines 38 and 45. When the panels reach positions approximating those shown in FIG. 3, the locking tabs 34–36 inclusive slidably engage the guide panels 2, 6 and 4 and the shoulder portions of these locking tabs move into and through the slits 8*a*, 8*b*, 12*a*, 12*b*, 10*a*, and 10*b* to occupy the positions represented by the tab 36 in FIG. 3 and rest on the shoulder of the associated bottle such as B1 and are thus effectively locked. The locking notch which receives locking tab 36 is identified by the fold line 10 and the end slits 10*b* and 10*c* which are perpendicular to the fold line 10 and to the end slits 10*a* and 10*b*. Slits 10*a* and 10*b* simply facilitate the entry of the shoulder portions 36*a* and 36*d*.

The opposite side of the carrier is simultaneously folded so that during upward folding of side wall 22 about fold line 23, support wall 26 is folded downwardly about fold line 27 while handle panel 44 is simultaneously folded upwardly about fold line 45. Of course the locking tabs 41–43 inclusive are guided into the locking notches formed along the inner portions of guide panels 3, 7 and 5 respectively. The fold line 11 as well as the end slits 11*c* and 11*d* constitute a locking notch associated with guide panel 5 and which cooperates with locking tab 43 as is obvious. The remaining locking tabs cooperate with their associated locking notches as is obvious.

Figure 4:
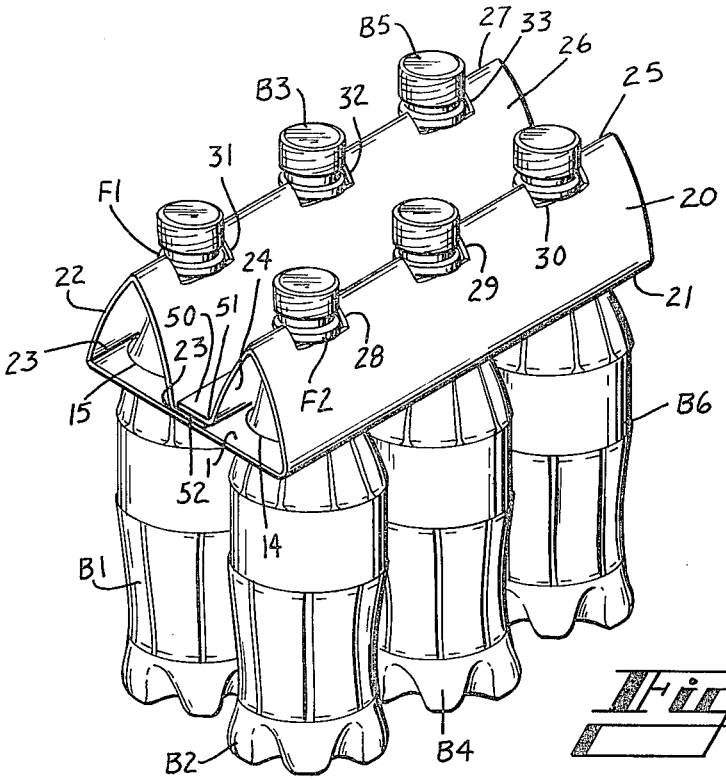
FIG. 4 is a view similar to FIG. 1 and depicts a modification of the invention in which the guide and handle panels are omitted and in which cover panels are substituted therefor.
Figure 6:
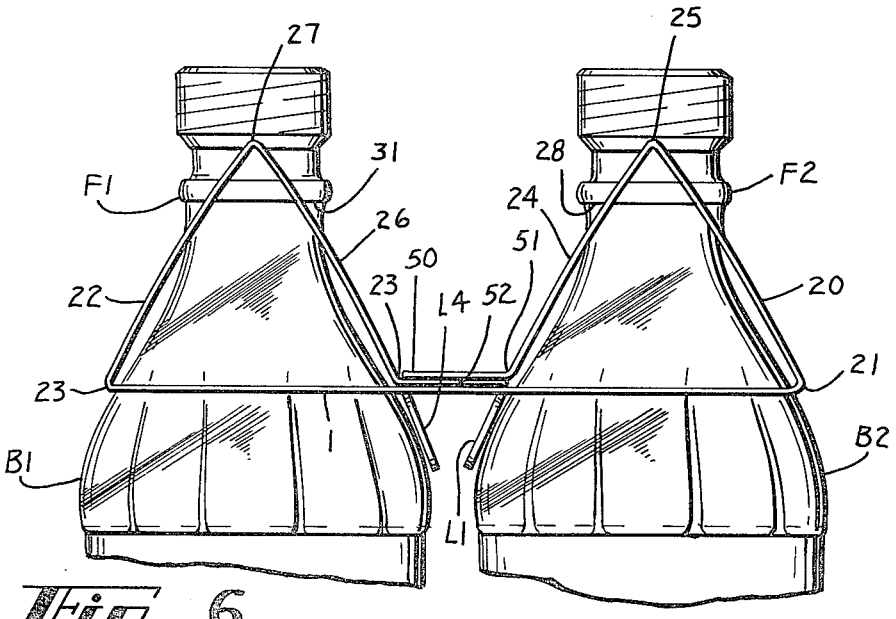
FIG. 5 is a view similar to FIG. 2 and depicts a blank from which the carrier of FIG. 4 is formed and FIG. 6 is a view similar to FIG. 3 and is an end view of a carrier formed from the blank of FIG. 5.
Figure 5:
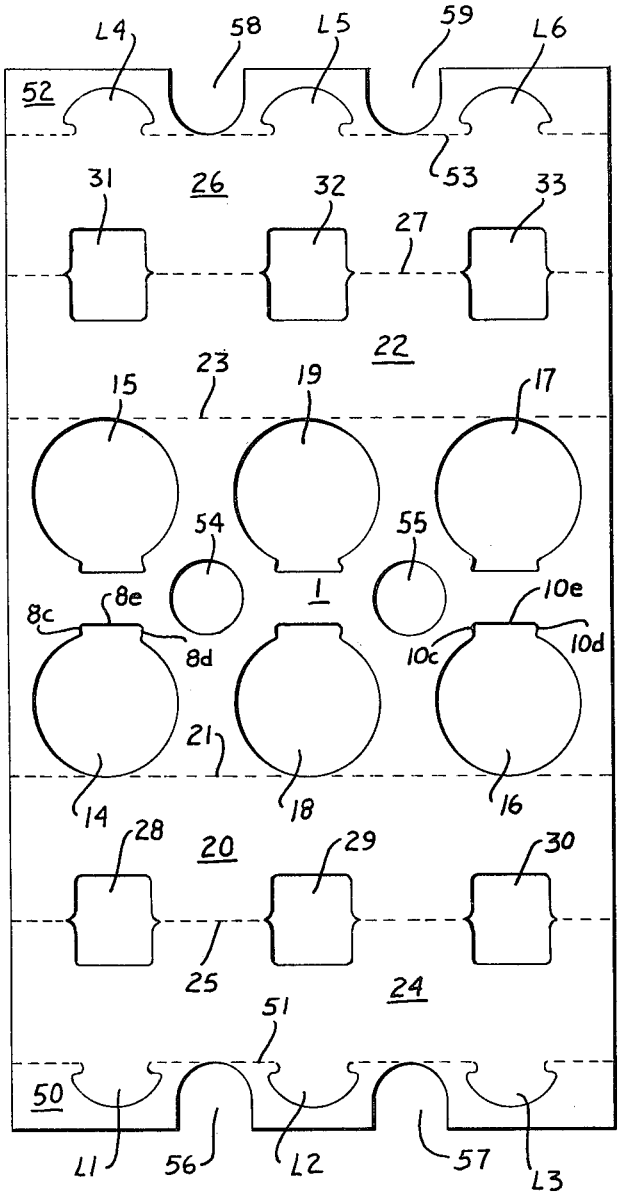

The modification of the invention as shown in FIGS. 4, 5 and 6 eliminates the guide panels 2–7 inclusive and the handle panels 37 and 44 which are included in the preferred arrangement shown in FIGS. 1, 2 and 3. For the purpose of overlying the medial portion of bottom panel 1 which is disposed between the neck receiving apertures 14–19 cover panel means 50 is foldably joined to support wall 24 along interrupted fold line 51 and cover panel means 52 is foldably joined to support wall 26 along interrupted fold line 53.

To facilitate portability of this carrier, a pair of finger gripping apertures 54 and 55 are formed in bottom panel 1 and when the carrier is assembled are disposed in coincidental relationship with the cutaway areas 56 and 57 respectively associated with cover panel means 50 and with cutaway areas 58 and 59 respectively associated with cover panel means 52. Locking tabs which are integrally formed with support wall 24 are similar to the locking tabs of the preferred modification but are configured somewhat differently and are designated L1, L2 and L3. Similar locking tabs integrally formed with support wall 26 are designated L4, L5, and L6. Since the arrangement of FIGS. 4, 5, and 6 does not include guide panels, the locking notch such as that associated with neck receiving aperture 16 comprises a slit 10*e* which corresponds generally with the fold line 10 in FIG. 2. The end slits 10*c* and 10*b* are substantially like the corresponding slits in FIG. 2 and are perpendicular to slit 10*e*.

In order to assemble the carrier from the blank shown in FIG. 5, side walls 20 and 22 are folded upwardly along fold lines 21 and 23 and simultaneously support walls 24 and 26 are folded inwardly along fold lines 25 and 27 respectively. Simultaneously cover panel means 50 and 52 are folded upwardly relative to their associated panels 24 and 26 along fold lines 51 and 53 respectively so that when the locking tabs L1–L3 enter the locking notches associated with neck receiving apertures 14, 18 and 16 respectively the cover panel 50 overlies the medial part of bottom wall 1 between the two rows of neck receiving apertures. While this operation is being performed, cover panel means 52 overlies the medial portion of bottom panel 1 between the neck receiving apertures. It is not significant whether cover panel 50 overlies panel 52 or vice versa and the sequence of folding determines the relationship of these panels as is obvious. When completely assembled, the carrier is lowered from above onto a group of bottles as shown in FIG. 6 to complete a package of six bottles.

It may be desirable for purposes of board economy or other factors to eliminate the cover panels 50 and 52. In order to do this, these panels would simply be severed from support panels 24 and 26 along their respective fold lines 51 and 53 as is obvious. In practice, during formation of the carrier, the cover panels according to this third form of the invention are simply omitted entirely and the locking tabs L1–L3 protrude outwardly from the edge 51 of support panel 24 and in like fashion locking tabs L4–L6 protrude outwardly from support panel 26. In this form of the invention that portion of bottom panel 1 which is disposed between the two rows of neck receiving apertures 14–17 is exposed to view from above.

One desirable feature of this invention resides in the fact that it lends itself for use in conjunction with cases of bottles such as a corrugated case arranged to package 24 bottles or four rows of six bottles each or four $2\times3$ bottle packages.

Another advantageous feature of this invention is due to the fact that it requires no glue and is very easily assembled and applied to groups of bottles. For example groups of bottles mounted in a case of 24 bottles may be packaged by simply lowering an assembled carrier formed according to any one of the forms of this invention from above downwardly at an inclined angle so that the front two bottle neck receiving apertures simply envelop the flanges F of the leading two bottles in a group of two by three bottles and by this means further continued movement of the case with its bottles allows the carrier to settle down over the group following which a rotary element rides down against a part of the carrier between the bottle neck receiving apertures to force the carrier downwardly and thus to cause the supporting portions such as 31*a* and 31*b* to ride below the flanges F of the packaged articles and thus to complete application of the carrier to a group of bottles.

INDUSTRIAL APPLICABILITY

While a bottle carrier constructed according to this invention is not limited to a particular size of bottle, it is particularly well suited for packaging bottles of medium size and which are formed with pronounced integral outwardly projecting flanges near the upper ends of their necks. For example the carrier is particularly well suited for packaging bottles of the one-half liter size and while it is best suited for use in packaging two rows of articles, the invention is not limited to more than one row of articles and is applicable as well to packaging a single row of bottles.

I claim:

1. A carrier of the top gripping type for engaging outwardly projecting elements on and near the tops of a plurality of bottles arranged in at least one row, said carrier comprising a bottom panel, a plurality of bottle neck receiving apertures formed in said bottom panel and arranged in at least one row, a locking notch formed along a side portion of each of said neck receiving apertures, a first inwardly inclined side wall foldably joined to a side edge of said bottom panel opposite from said notches, an inwardly inclined support wall foldably joined at its upper edge to the upper edge of said inwardly inclined side wall, a plurality of support apertures formed in the upper portions of said side and said support walls and arranged to receive the upper portions of the necks of said bottles and to engage said outwardly projecting elements of said bottles, and a plurality of locking tabs formed along the bottom edge of said support wall and arranged to engage said notches respectively so as to interconnect said inwardly inclined support wall with said bottom panel.

2. A carrier according to claim 1 wherein said locking tabs are arranged to engage the necks of the associated bottles respectively and thereby to secure said locking tabs against dislodgment from their associated locking notches.

3. A carrier according to claim 1 wherein each of said locking tabs comprising a neck portion and a pair of shoulder portions.

4. A carrier according to claim 1 wherein each of said notches is defined by a cutaway peripheral portion of the associated neck receiving aperture and comprises a longitudinal edge generally parallel with the side edges of said bottom panel and a pair of spaced transverse end edges extending between said longitudinal edge and the associated neck receiving aperture.

5. A carrier according to claim 4 wherein the ends of each of said longitudinal edges extend into said bottom panel to points which are spaced apart by a distance somewhat greater than the spacing between said transverse end edges.

6. A carrier of the top gripping type for engaging outwardly projecting elements on and near the tops of a plurality of bottles arranged in at least two rows of at least two bottles each, said carrier comprising a bottom panel, a plurality of bottle neck receiving apertures formed in said bottom panel and arranged in at least two rows of at least two apertures each, a locking notch formed in each of said neck receiving apertures at a part thereof remote from the adjacent side edge of said bottom panel, an inwardly inclined side wall foldably joined to each side edge of said bottom panel, an inwardly inclined support wall foldably joined to the top edge of each of said side walls, a plurality of apertures formed in each of said side walls and in each of said support walls near the upper edges thereof to define a plurality of neck receiving apertures for engaging said outwardly projecting elements of said bottles respectively, and a plurality of locking tabs formed along the bottom edges of said support walls and arranged to engage said notches respectively thereby to interconnect said inwardly inclined support walls with said bottom panel.

7. A carrier according to claim 6 wherein the bottom edges of said support walls are spaced apart and wherein a cover panel is foldably joined to the bottom edge of at least one of said support walls and arranged in overlying relation to the medial portion of said bottom panel which is intermediate the bottom edges of said support walls.

8. A carrier according to claim 6 wherein the bottom edges of said support walls are spaced apart and wherein a pair of finger receiving apertures are formed in a medial part of said bottom panel which is intermediate the bottom edges of said support walls.

9. A carrier according to claim 7 wherein a pair of coincidental finger gripping openings are formed in said bottom panel and in said cover panel.

10. A carrier according to claim 6 wherein a pair of inwardly tapered handle panels are foldably joined at their bottom edges to the bottom edges of said support walls respectively.

11. A carrier according to claim 10 wherein a guide panel struck from each of said bottle neck receiving apertures is foldably joined to said bottom panel at said notches and interposed between said handle panels.

12. A carrier according to claim 11 wherein said guide panels engage and guide said locking tabs into said notches respectively during assembly of the carrier.

13. A carrier according to claim 11 wherein at least one finger receiving aperture is formed in each of said handle panels and in at least one of said guide panels and wherein said apertures are disposed in coincidental relation.

14. A blank for a bottle carrier of the top gripping type comprising a bottom panel, a plurality of bottle neck receiving apertures formed in said bottom panel and arranged in at least two rows between and parallel to the side edges thereof, a plurality of locking notches formed in said bottom panel at the side edges of said bottle neck receiving apertures adjacent one side edge of said bottom panel and communicating with said bottle neck receiving apertures respectively, a pair of side wall panels foldably joined along the bottom edges thereof to the side edges of said bottom panel respectively, a pair of support panels foldably joined respectively along the top edges thereof to the edges of said side walls remote from said bottom panel, a plurality of support apertures disposed astride each fold line adjoining each of said side walls and its associated support wall, and a plurality of locking tabs integrally formed with each of said support panels and projecting from the edge thereof remote from the associated side wall.

15. A blank according to claim 14 wherein said support apertures are of generally rectangular configuration.

16. A blank according to claim 14 wherein a handle panel is foldably joined to each of said support panels at the edge thereof remote from the associated side wall.

17. A blank according to claim 14 wherein cover panel means is foldably joined to at least one of said support panels at the edge thereof remote from the associated side wall.

18. A blank according to claim 14 wherein a guide panel is struck from said bottom panel at each of said neck receiving apertures and is foldably joined thereto at the associated locking notch.

19. A blank according to claim 16 wherein at least one finger receiving aperture is formed in each of said handle panels.

* * * * *